US005772511A

United States Patent [19]

Smeltzer

[11] Patent Number: 5,772,511

[45] Date of Patent: Jun. 30, 1998

[54] METHOD FOR THE CONDUCT OF LOTTERIES

[75] Inventor: Walter M. Smeltzer, Oklahoma City, Okla.

[73] Assignee: Webcraft Games, Inc., Winnipeg, Canada

[21] Appl. No.: 647,400

[22] Filed: May 8, 1996

[51] Int. Cl.[6] ..... A63F 3/06

[52] U.S. Cl. ..... 463/17

[58] Field of Search ..... 463/16, 17, 18, 463/19, 20, 21; 379/88, 92, 95, 97

[56] References Cited

U.S. PATENT DOCUMENTS

| | | | |
|---|---|---|---|
| 4,591,190 | 5/1986 | Clark | 283/102 |
| 4,634,149 | 1/1987 | Donovan | 283/102 |
| 4,953,895 | 9/1990 | Goussios | 283/102 |
| 5,046,737 | 9/1991 | Fienberg | 273/139 |
| 5,158,293 | 10/1992 | Mullins | 273/139 |
| 5,365,575 | 11/1994 | Katz | 379/92 |
| 5,569,082 | 10/1996 | Kaye | 463/17 |

*Primary Examiner*—George Manuel
*Attorney, Agent, or Firm*—Leydig, Voit & Mayer, Ltd.

[57] ABSTRACT

A method for conducting lotteries which combines instant games and on-line games by beginning with the purchase of a single instant game ticket by a player. The instant game is played and, win or lose, the instant game ticket is presented for verification. The transmission of the results of the verification directs payment as to winning tickets and directs continuing play of an on-line game for all tickets. The on-line game is played through the selection of numbers by the player or by random number selection and a on-line game ticket is printed for use in playing the on-line game.

16 Claims, 4 Drawing Sheets

METHOD FOR THE CONDUCT OF LOTTERIES

FIELD OF THE INVENTION

The present invention relates generally to the conduct of on-line lotteries and instant ticket lottery games which are used as revenue gathering vehicles.

BACKGROUND OF THE INVENTION

Lotteries conducted by various organizations have long been accepted methods for the raising of revenue and for providing a source of entertainment and the possibility of winning valuable prizes by lottery players. In recent years, States have employed the lottery vehicle in a number of different manners of presentation. Such manners of presentation have included, among others, the use of preprinted game tickets and computer generated game tickets which are printed at the time of purchase.

Preprinted game tickets, which can sometimes be referred to as instant game tickets, are small, card-like tickets which are preprinted by the ticket manufacturer with game indicia on the ticket which can include specific game identification and unique ticket identification information for use in the verification process, game playing instructions on the manner of play of the game and possible game playing selections available to a player.

Game identification information, which distinguishes one game from another game, is frequently presented in the form of a scanable number or bar code. Unique ticket identification information is unique to each ticket and is also frequently presented in the form of a scanable number or bar code. Such information interfaces with a lottery centralized computer which maintains a data base of corresponding identification information, prize information and the like. Game playing selection indicia identifies various choices available to a player in playing a game. Such information is typically obscured by covering it with a removable coating, such coating being removable by the player by scratching it off with a coin or fingernail. The tickets are sold at ticket retail stores, such as state lottery ticket outlets, drug stores, tobacco stores, and the like. The player purchases a ticket on an individual basis, then removes the obscuring coating to reveal the preprinted game playing selection underneath.

The instant aspect of this type of game is immediately evident upon the removal of the obscuring coating by revealing the results of game playing selections which meet preestablished winning criteria. For example, an instant game built around the well-known game of Tic-Tac-Toe can have the preprinted game playing selections on a game board obscured. When the coating over three spaces is removed, if those three spaces disclose Xs or Os in a winning pattern, that ticket is an instant winner. Similarly, games can require the multiple matching of symbols, for example, cherries or dollar amounts, which define the prize or the amount of the prize in order for an instant win. The prize or prize amount is generally readily visible on the ticket or revealed with the removal of an obscuring coating.

Typically, the prize amount is immediately collectable at the ticket retail place of purchase with the presentation of the winning ticket. Such winning instant game tickets are usually the subjects of an information verification process at the place of purchase through the communication of the game identification and unique ticket information preprinted on the ticket to a centralized computer data base maintained by the proponent lottery to confirm the prize. This verification system, among other functions, centrally confirms the identification of the verified ticket, accounts for the pay-out of prizes and also serves as a security check to aid in the identification of spurious tickets.

Winning instant tickets are retained by the verifying entity at the ticket retail store and subsequently disposed of. Losing instant game tickets have no requirement for verification through the presentation of the ticket at the ticket retail store. As is readily observable in the geographical area around instant game ticket retail stores, losing tickets are often haphazardly discarded and can present litter problems.

Such instant games generally constitute a single play, with no further play capability following the initial scratch off of obscuring coating and provide for no continuing involvement by the player. In recent years, in an effort to make these instant games more attractive to potential purchasers, and thus provide a greater revenue-raising opportunity, instant games have been creatively decorated with colorful graphics and the underlying complexity of the game has progressed from simple games such as Tic-Tac-Toe to more sophisticated games such as keno or poker. States have conducted expensive advertising campaigns to increase public awareness of such instant games, in an effort to increase game ticket sales with the resulting increase in revenue. However, the basic player-to-game relationship of an instant win (or instant loss), instant pay-off and single play limitation has remained generally unchanged.

A second type of lottery game which has enjoyed increasing popularity of late involves the interface of a player, a game involving the selection of numbers, and a centralized computer base, which is commonly referred to as an on-line game. Such an on-line game involves the purchase by a player of a game ticket which is generated and printed at the place of purchase by a computer which is in on-line communication with the lottery centralized computer data base. Such on-line games, which can be conducted on a daily or weekly basis, involve the selection of a specified number having a restricted number of digits or limited group or series of numbers, often between a restricted range. For example, a player might select a single number, having four digits (between 0000 and 9999), e.g., 3187, or a player may select a group of six numbers comprised of two digits each, which range between 1 and 42, e.g., 14 36 22 07 29 40. The selection of such numbers can be made by the player at the place of purchase through the identification of the selection by the player to the ticket sales person by submitting a computer-readable number selection form or the selection of such numbers can be made for the player and are randomly generated by the supporting computer system.

In either case, an on-line game ticket is printed at the time of number selection or generation at the place of purchase and provided to the player. In this type of game, however, there is no instant win or instant loss. Rather, the game upon which winning or losing depends is generally based upon a publicized, centralized number selection made by lottery officials at some specified date. Daily selections of on-line game winning numbers are popular as are weekly selections wherein prizes of greater value are available. For example, a state lottery makes the number selections at an appointed date and time and the selection is often televised and publicly reported. Winning is dependent upon the completeness of the matching of numbers selected by the player as displayed on the on-line game ticket with the winning numbers selected by the state lottery. Pay-out on winning tickets can be made at the place of purchase or, depending upon the amount, at a designated location. Validation of such tickets, as with the instant ticket, involves the verification of the data printed on the ticket at the time of purchase with the data stored in a lottery centralized computer data base. Generally, the on-line game is also a single play game, with no subsequent player involvement after the winning numbers are selected.

Efforts to generate a new type of game which can accommodate multiple plays have proven to be generally unsuccessful. For example, in a effort to convert instant, single play games into multiple play games, certain state lotteries have included on the pre-printed instant tickets instructions for a second chance to win. Such instructions direct the player to mail the ticket to the controlling state lottery office for a subsequent secondary drawing. This effort has met with little success and is not popular with game players. Further, player involvement in the game itself is generally ended with the initial scratch off of obscuring coating. Similarly, multiple play efforts using on-line games are typically restricted to the single player-involved selection of numbers by the player and the manner such player selected numbers interface with the winning selected numbers.

An effort to extend player involvement by linking instant games and on-line games can be seen in U.S. Pat. No. 5,158,293 to Mullin. This patent discloses a lottery game and a method for playing a lottery game which links both the instant game and an on-line game or what is characterized therein as a jackpot game, with the addition of a bonus game. However, the games are played with a multi-sectional ticket presenting a complex series of pre-printed numbers and game playing selections available to the player. The conduct of the lottery disclosed is complicated and instructions for play involve a multitude of selections.

An identified problem with the lottery disclosed in U.S. Pat. No. 5,158,293 to Mullin is the complex nature of the multi-sectional ticket which must be separated into two ticket halves at a perforation to play the instant game separately and the remaining portion retained for playing the jackpot game. The instant game is played in the typical manner by scratching off obscuring coating to reveal game playing selections. Only winning instant game ticket halves are presented for verification. For playing the jackpot game which remains on the second half of the ticket, players must scratch off obscuring coating to reveal the jackpot game playing numbers. Winning tickets are subject to a second verification. Further scratch offs are necessary to determine eligibility for the bonus game. Revealed information on winning tickets must thus be verified a number of times by the lottery centralized computer data base.

An additional problem associated with this type of lottery game is that all game playing selections available to the player have been pre-determined solely through computer random number generation and pre-printed on the multi-sectional ticket. Player input into the number selection in the jackpot game is excluded, because the ticket has been pre-printed. Additionally, such a ticket can be subject to improper efforts to ascertain whether winning information for an instant game, a jackpot game and a bonus game is printed thereon. Further, there is a perception by players that the pre-printed information has removed the random nature of the jackpot or in-line game number selection, which is no longer made by the player or generated in the player's presence at the time of ticket purchase. This method has not been well accepted by the lottery game playing public.

Further difficulties are presented by the very limitations of both the instant game and the on-line game. Game formats and manners of play are developed and advertised to stimulate player participation and sales of tickets, but the promotion of new games is constrained by the preprinted, single play nature of the instant game and the absence of the potential for instant winning in the on-line game.

BRIEF SUMMARY OF THE INVENTION

It is therefore a primary objective of the present invention to provide a method for conducting a lottery which provides for the playing of a combined game which includes an instant game in conjunction with the playing of an on-line game through the purchase of a single ticket.

It is an object of the present invention to provide a method for conducting a lottery which increases the player's participation in the lottery process in a combined game.

Another object of the present invention is to provide a method for conducting lotteries which incorporates an existing instant game with an existing on-line game so that the lottery can take advantage of existing promotional efforts on the individual games to promote the combined game.

It is a further object of the present invention to provide a method for conducting lotteries which deviates significantly from the present manner of playing lotteries, thereby providing for enhanced promotional efforts directed to a combined game.

A related object of the present invention is to provide a method for the conduct of lotteries wherein this method can be used to coordinate an existing instant game with a newly-developed on-line game or to coordinate an existing on-line game with a newly-developed instant game, thereby providing for enhanced advertising and increased player interest in the newly-developed game by using the method of the present invention to combine the two games.

It is yet another objective of the present invention to provide for the verification and collection of all instant game tickets, which permits the proper disposal of all tickets.

These and other objects and advantages of the present invention, as well as additional inventive features, will be apparent from the description of the invention provided herein.

Figure 1:
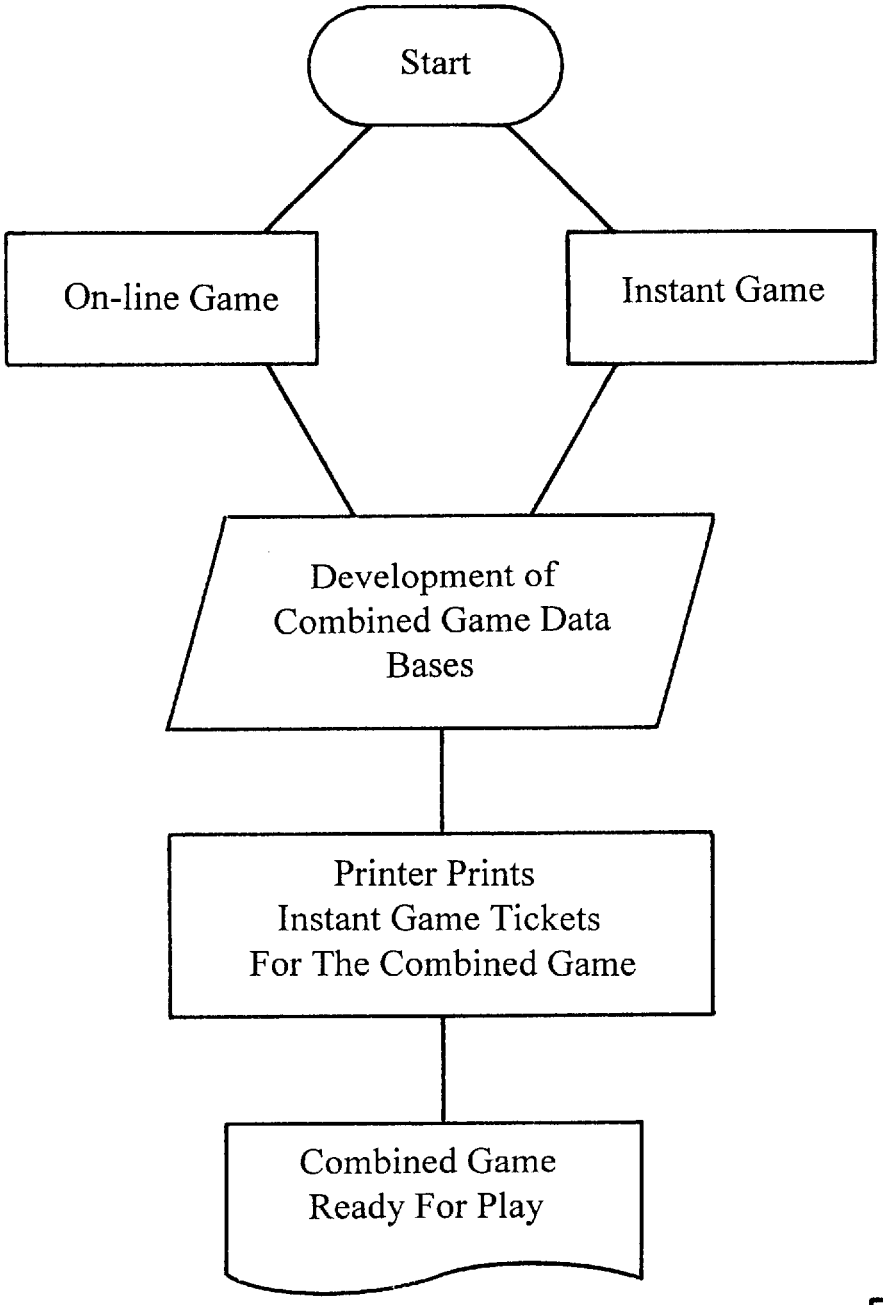
FIG. 1 is flowchart diagram illustrating the method of the present invention in the development of the combined game.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DESCRIPTION OF THE PREFERRED EMBODIMENTS

The invention may best be understood with reference to the accompanying drawings wherein an illustrative embodiment is shown and in the following detailed description of the preferred embodiment.

Referring generally to FIG. 1 of the drawings, the lottery combines an instant game with an on-line game. The manner of play of each game is considered to coordinate the two games into the combined game of the present invention. The combination of two games presents novel promotional opportunities. Promotional campaigns can be developed reflecting the combined nature of an instant game with an on-line game.

Typically, the instant game and the on-line game will each have a separate computerized data base for, among other things, game identification, unique ticket verification, ticket accountability and a record of prizes awarded. Such data for instant games is often provided by the ticket manufacturer or game proponent to the lottery to be maintained in the lottery centralized computer data base. For the combined game of the present invention, data bases must be coordinated so that ticket verification in the instant game cooperates with the data base for the online game. For purposes of the present invention, this data base must include verification data for all instant tickets which are distributed for sale. The production of and coordination of supporting data base information in the field of lottery operations is well-known to those of ordinary skill in the art of lottery data support development and is not a subject of the present invention.

The lottery promotional department can use the combined game of the present invention to emphasize and create additional interest in existing games in order to take advantage of on-going promotion or to use the popularity of one game to enhance the participation in the other game. Alternatively, the lottery can promote the new combined game as an new gaming concept, independent of existing games. As part of the combined game development, the lottery develops such elements which are inherent to all games, including names of the games, manners of play, prize tiers and the like. Instant game tickets are printed and the necessary computer data bases are implemented for the start of the lottery.

Figure 2:
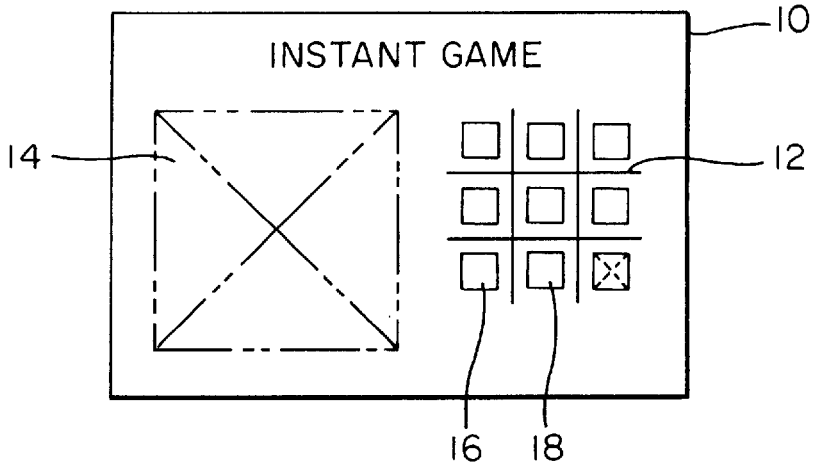
FIG. 2 is the obverse of a representative instant game ticket with game playing selections obscured.
Figure 4:
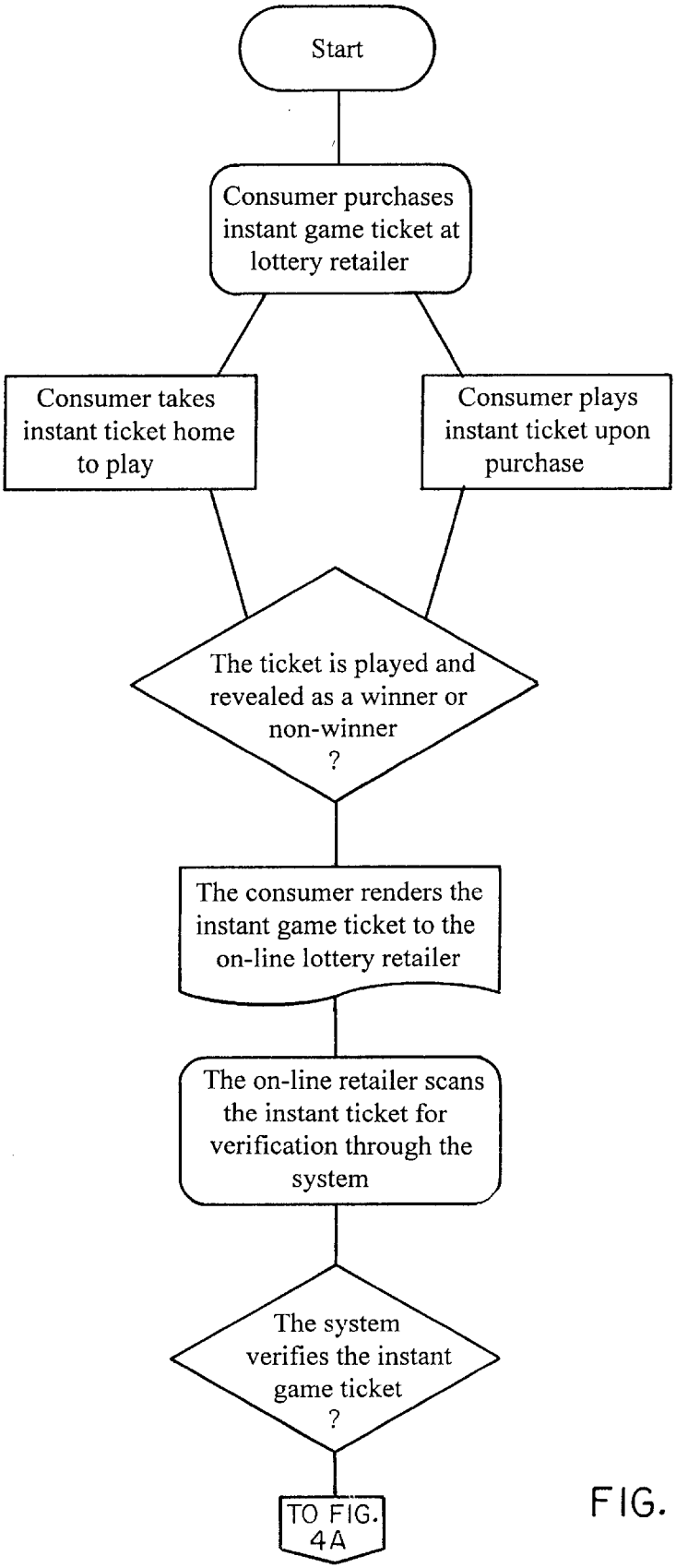
FIG. 4 is flowchart diagram illustrating the method of the present invention in operation.
Figure 4A:
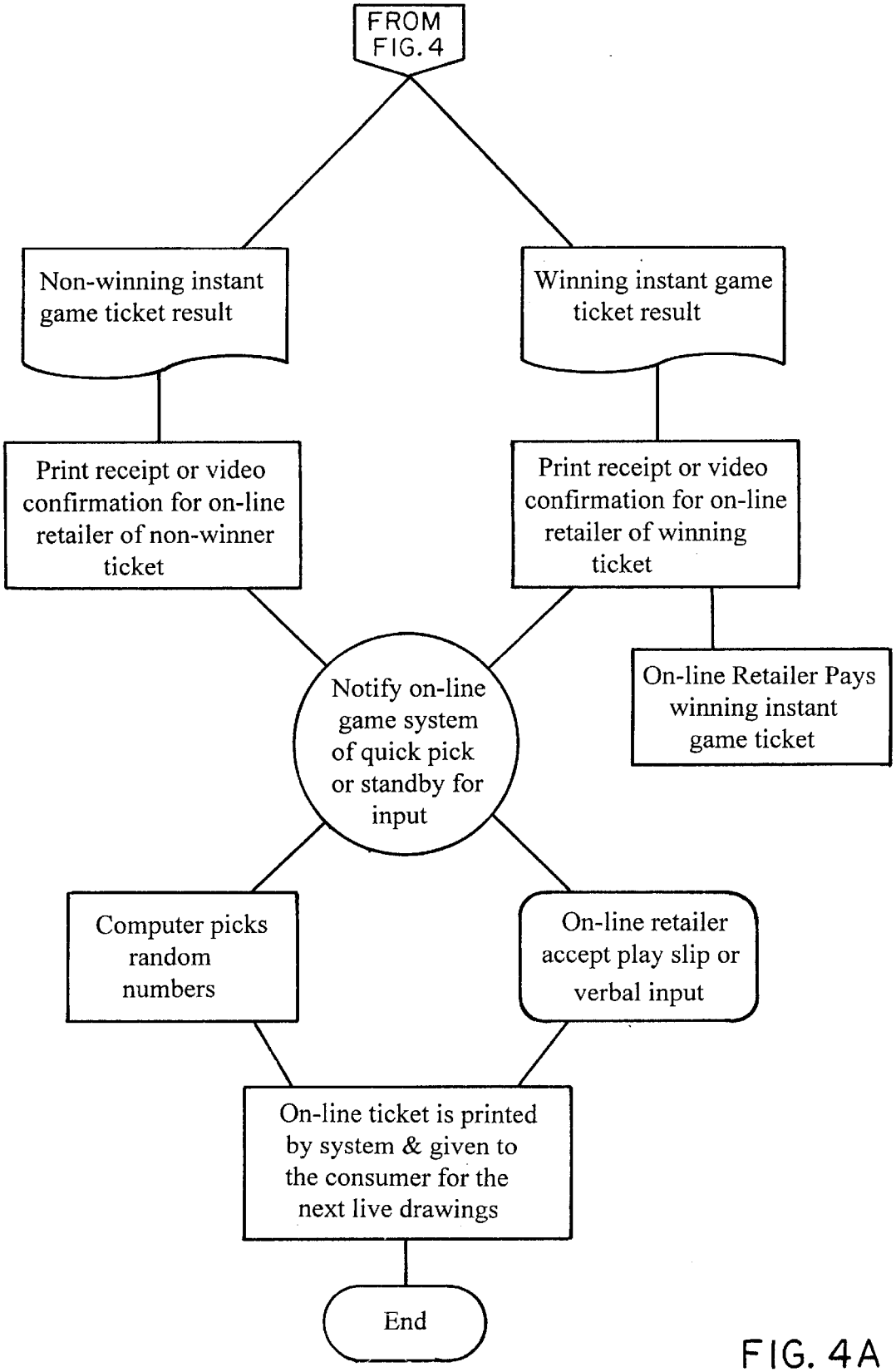
FIG. 4A is continuation of the flowchart diagram of FIG. 4, illustrating the method of the present invention in operation.

The first step in actually playing the lottery by the method of the present invention, as seen in FIG. 4, is the purchase by the game player of an instant game ticket 10 (FIG. 1) from a lottery ticket sales retailer. For the illustrative embodiment, the game Tic-Tac-Toe is addressed; however, other games and manners of play can be utilized. As can be seen in FIG. 2, the instant game ticket 10 incorporates game playing indicia which has been pre-printed on it by the ticket manufacturer. Such information includes a Tic-Tac-Toe gameboard 12, game playing instructions 14 (shown as a space available for such instructions), available game playing selections 16 and chosen selections 19 (FIG. 2A), which in this case are initially covered by a removable, obscuring coating 18.

Figure 2A:
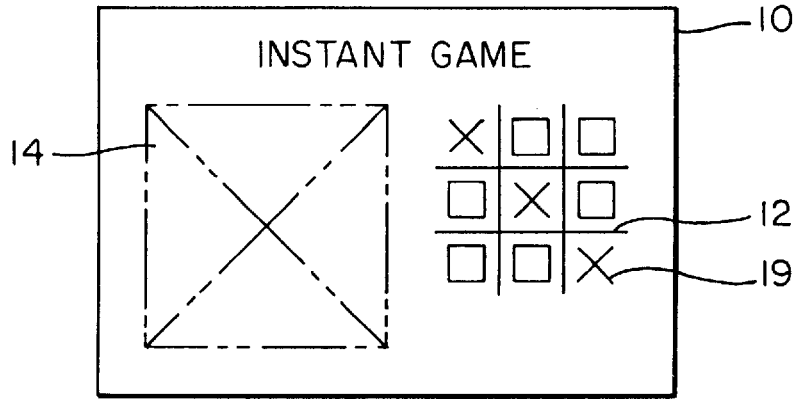
FIG. 2A is the obverse of a representative instant game ticket with the obscuring coating removed and the game playing selections exposed.

In a procedure which can take place immediately or at sometime thereafter, but within the time constraints of the on-line game winning number selection date, the player makes a selection from available game playing selections 16 by removing coating 18 using, for example, a coin or a fingernail, in accordance with game playing instructions 14 to reveal chosen selections 19. As can be seen in FIG. 2A, in the Tic-Tac-Toe example, the player has removed the coating 18 from three game playing selections 16 on the game board 12 pursuant to game playing instructions 14. Three Xs diagonally across the game board 12 are thus revealed. In accordance with the game playing instructions 14, this instant game ticket 10 now constitutes a winning ticket. It must be noted that the process for conducting a lottery in accordance with the present invention is not dependent upon whether the instant game ticket 10 is a winning ticket or a losing ticket. The combined game perpetuates the involvement of the player with a losing instant game ticket, for all instant game tickets continue to play in the combined game of the present invention.

Figure 3:
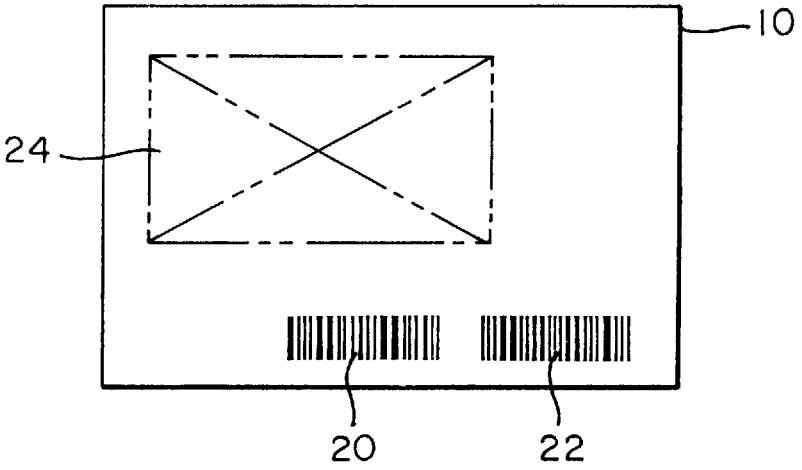
FIG. 3 is the reverse of a representative instant game ticket displaying specific game identification and unique ticket identification information.

Continuing the example, the player presents the instant game ticket 10 to the lottery ticket sales retailer for verification. As can be seen in FIG. 3, the reverse of the instant game ticket 10 displays pre-printed verification information, which includes specific game identification information 20 and unique ticket identification information 22, which in the case of the illustrated embodiment are shown as bar codes, although numbers, letters or the like can be used, along with a space 24 for the preprinting of lottery rules or the like. The lottery ticket retailer verifies the winning ticket by scanning or otherwise inputting the specific game identification information 20 and unique ticket identification 22 into an on-line computer at the retail store which is in communication with the lottery centralized data base.

As shown in FIG. 4, in response to a verification request by the lottery ticket sales retailer, the lottery centralized computer data base verifies the specific game identification information 20 and unique ticket identification information 22 to confirm that the subject instant game ticket 10 is a winner of the game to which it pertains. In the case where the instant game ticket 10 is a loser, the specific game identification information 20 and unique ticket identification information 22 is similarly verified. In either event, the lottery centralized computer transmits a confirmation of this verification to the lottery ticket sales retailer. This confirmation can be in the form of a printed receipt or a video confirmation on the computer screen of the retailer. In the case of the winning ticket, the retailer pays the player the amount of the prize associated with the winning ticket which has been verified by the lottery centralized computer. Having ssurrendered instant game ticket 10, whether a winning ticket or a losing ticket, to the retailer for verification, these tickets are of no further use to the player. In some circumstances, winning tickets are forwarded by the retailer to the lottery office. All others can be properly disposed of by the ticket retailer.

At this point, the combined game continues and involves further player participation regardless of winning or losing the preceding instant game and connects the now-completed instant game with the on-line game. Following the verification of either a winning or losing instant game ticket 10, the retailer is prompted by the central computer to either accept input of a player's own on-line game playing selections, i.e., her own selected numbers or what is commonly referred to as a quick pick. A quick pick is the selection of such numbers by submitting a computer-readable number selection form, or what is referred to as a play slip, to the ticket sales person, or the selected numbers could be conveyed to the ticket sales person orally. Alternatively, the player may initiate the generation of random number selection by the computer support system in accordance with the manner of play of the on-line game. The response to the central computer prompting is the presentation of selected numbers to the on-line computer.

An on-line ticket is then printed at the place of purchase by the retailer reflecting the numbers either selected by the player or randomly generated. The method of the present invention is completed with the presentation of the on-line ticket to the player. This ticket is then retained by the player until the announcement of the results of the on-line, live drawing of winning game numbers in the appropriate on-line game.

What is claimed is:

1. A method for conducting lotteries which combines an instant game and an on-line game so that the purchase of a single game ticket by a player will provide for active player participation in the instant game and active player participation in the number selection at the direction of the player in the on-line game.

2. A method of claim 1 wherein the active player participation in the instant game includes the making of chosen selections by the player from available game playing selections which are preprinted on the instant game ticket.

3. A method of claim 1 wherein all number selections for playing the on-line game are picked by the player.

4. A method of claim 1 wherein the number selections for playing the on-line game are randomly selected by a computer pursuant to player direction to so randomly select.

5. A method for conducting lotteries which combines an instant game and an on-line game, including the following steps:

(a) the purchase of an instant game ticket by a player which presents preprinted available game playing selections and verification information thereon;

(b) selection by the player, from the available game playing selections presented on the instant game ticket, of certain chosen selections:

(c) presentation of the instant game ticket for verification;

(d) verification of the information on the instant game ticket by a computer;

(e) transmissions of the results of the verification;

(f) immediate access by the player to the on-line game;

(g) selection by the player of numbers for playing the on-line game and on-line presentation of the selected numbers; and (h) generation by the computer of an on-line game ticket imprinted with the selected numbers for use in playing the on-line game.

6. A method of claim 5 wherein the verification information on the instant game ticket includes game identification information and unique ticket identification information.

7. A method of claim 6 wherein the verification information is presented in a form that is readable by a computer.

8. A method of claim 7 wherein the verification information is in the form of a bar code.

9. A method of claim 5 wherein the chosen selections result in a winning ticket.

10. A method of claim 9 wherein the verification of the information on the instant ticket confirms the chosen selections and identifies the instant ticket as a winning ticket with an associated prize.

11. A method of claim 10 wherein the transmission of the results of the verification includes a direction to pay the associated prize.

12. A method of claim 5 wherein the immediate access by the player to an on-line game permits the input into the computer of the player's selected numbers for playing the on-line game.

13. A method of claim 12 wherein the player's selected numbers are provided by the player.

14. A method of claim 12 wherein the player's selected numbers are provided by computer-generated random number selection.

15. A method of claim 5 wherein the preprinted available game playing selections are obscured by a removal coating.

16. A method of claim 5 wherein all instant games tickets presented for verification are disposed of.

* * * * *